US008806876B2

(12) United States Patent
Shimoda et al.

(10) Patent No.: US 8,806,876 B2
(45) Date of Patent: Aug. 19, 2014

(54) REFRIGERATION APPARATUS

(75) Inventors: Junichi Shimoda, Osaka (JP); Hidehiko Kinoshita, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 519 days.

(21) Appl. No.: 12/377,084

(22) PCT Filed: Aug. 3, 2007

(86) PCT No.: PCT/JP2007/065255

§ 371 (c)(1),
(2), (4) Date: Feb. 10, 2009

(87) PCT Pub. No.: WO2008/018381

PCT Pub. Date: Feb. 14, 2008

(65) Prior Publication Data

US 2010/0162742 A1 Jul. 1, 2010

(30) Foreign Application Priority Data

Aug. 11, 2006 (JP) ..... 2006-219251

(51) Int. Cl.
*F25B 43/02* (2006.01)
*F25B 31/00* (2006.01)

(52) U.S. Cl.
USPC ..... 62/84; 62/192; 62/193; 62/468; 62/472

(58) Field of Classification Search
USPC ..... 62/84, 192, 193, 468, 472
See application file for complete search history.

(56) References Cited

U.S. PATENT DOCUMENTS

| | | | | |
|---|---|---|---|---|
| 5,012,652 | A * | 5/1991 | Dudley | 62/192 |
| 5,224,353 | A * | 7/1993 | Nagasawa | 62/209 |
| 5,230,222 | A * | 7/1993 | Erbs | 62/192 |
| 5,669,226 | A * | 9/1997 | Kurahashi et al. | 62/227 |
| 6,826,924 | B2 * | 12/2004 | Shimoda et al. | 62/324.4 |

FOREIGN PATENT DOCUMENTS

| | | | |
|---|---|---|---|
| JP | 61-213555 | A | 9/1986 |
| JP | 1-300149 | A | 12/1989 |
| JP | 10-30563 | A | 2/1998 |
| JP | 2002-31386 | A | 1/2002 |
| JP | 2002-106981 | A | 4/2002 |

* cited by examiner

*Primary Examiner* — Judy Swann
*Assistant Examiner* — Ian Soule
(74) *Attorney, Agent, or Firm* — Birch, Stewart, Kolasch & Birch, LLP.

(57) ABSTRACT

An air conditioner (10) composed of a refrigerating apparatus includes a controller (90). A heating control section (91) of the controller (90) feeds electric current in an open phase state to an electric motor (62) of a compressor (30) to heat the compressor (30) in operation stop of the air conditioner (10). The heating control section (91) monitors the detection value of an outdoor air temperature sensor (72) during the operation stop of the air conditioner (10) and keeps on stopping feeding the electric current to the electric motor (62) during the time when the detection value decreases.

1 Claim, 5 Drawing Sheets

REFRIGERATION APPARATUS

TECHNICAL FIELD

The present invention relates to control of means for heating a compressor during operation stop of a refrigerating apparatus.

BACKGROUND ART

In operation stop of a refrigerating apparatus, refrigerant accumulates into a compressor in some cases. For example, in the case where the compressor is accommodated in an outdoor unit installed outdoors, when the temperature of the compressor lowers in winter when the outdoor temperature is low, the refrigerant in a refrigerant circuit is condensed to accumulate in the compressor. The refrigerant accumulating in the compressor is mixed with lubricant oil stored in the compressor to lower the viscosity of the lubricant oil. When the compressor is activated in this state, the low-viscosity lubricant oil is supplied to the sliding portion of the compressor to cause lubrication failure, thereby inviting seizing. Further, the refrigerant mixed with the lubricant oil may be gasified at once at activation of the compressor to make the lubricant oil to be in a foamy state, causing insufficient oil supply.

To tackle this problem, a countermeasure has been provided which prevents accumulation of the refrigerant in the compressor by heating the compressor during operation stop of the refrigerating apparatus. For example, Patent Document 1 discloses that an electric heater is mounted at the compressor to heat the compressor through conduction of the electric heater. As well, Patent Document 2 discloses that low voltage at high frequency is applied to the coil of an electric motor provided at the compressor to cause the coil to generate Joule heat for heating the compressor without causing rotation of the electric motor.

In the case where the compressor is heated during the operation stop of the refrigerating apparatus as above, energy, such as electric power and the like is consumed even during the operation stop of the refrigerating apparatus. In order to solve this problem, Patent Document 1 discloses that: whether to conduct the electric heater is judged on the basis of the outdoor air temperature and the indoor air temperature; and when it is judged that compressor heating is unnecessary, the conduction of the electric heater is stopped. Specifically, in Patent Document 1, when the difference between the outdoor air temperature and the indoor air temperature is equal to or larger than a predetermined value and the outdoor air temperature is equal to or higher than a predetermined value, the conduction of the electric heater is stopped on the ground that it is judged that less mount of the refrigerant will accumulate into the compressor.

Patent Document 1: Japanese Patent Application Laid Open Publication No. 2002-106981

Patent Document 2: Japanese Patent Application Laid Open Publication No. 2002-031386

SUMMARY OF THE INVENTION

Problems that the Invention is to Solve

In many cases, the refrigerant circuits of the refrigerating apparatuses are so constructed that a communication pipe connects a unit on the outdoor side including a compressor and a heat source side heat exchanger and a unit on the indoor side including a user side heat exchanger. Accordingly, when the outdoor air temperature is lower than the indoor air temperature, the refrigerant accumulates into the unit on the outdoor side.

Nevertheless, the refrigerant does not necessarily accumulate into the compressor even under the state that the refrigerant accumulates into the unit on the outdoor side. Because: the unit on the outdoor side includes the heat source side heat exchanger besides the compressor, and therefore, the refrigerant may accumulate into the heat source side heat exchanger rather than the compressor. In this case, it is unnecessary to heat the compressor.

When the indoor and outdoor air temperatures are taken into consideration, as described in Patent Document 1, however, into which the refrigerant accumulates, the unit on the indoor side or the unit on the outdoor side, can be judged, but whether the current state is a state where the refrigerant accumulates into the compressor cannot be judged. Under the circumstances, the compressor is heated even in the state where less amount of the refrigerant accumulates into the compressor, thereby consuming unnecessary energy.

The present invention has been made in view of the foregoing and has its object of reducing energy consumption during operation stop of a refrigerating apparatus by appropriately judging whether the current state is a state where a large amount of refrigerant accumulates into a compressor.

Means for Solving the Problems

A first aspect of the present invention is directed to a refrigerating apparatus including a refrigerant circuit (20) which performs a refrigeration cycle by circulating refrigerant and which includes: a heat source side circuit (21) including a compressor (30) and a heat source side heat exchanger (34) and installed outdoors; and a user side circuit (22) including a user side heat exchanger (37) and installed indoors, the heat source side circuit (21) and the user side circuit (22) being connected to each other, and the heat source side heat exchanger (34) performing heat exchange between the refrigerant and outdoor air. Wherein, the refrigerating apparatus further includes: heating means (80) which heats the compressor (30) in operation stop of the refrigerating apparatus; outdoor air temperature detection means (72) which detects a temperature of the outdoor air; and control means (91) which keeps the heating means (80) stopping heating the compressor (30) during the time when a detection value of the outdoor air temperature detection means (72) decreases in the operation stop of the refrigerating apparatus.

In the first aspect of the present invention, the heating means (80) heats the compressor (30) in the operation stop of the refrigerating apparatus (10) to prevent the refrigerant in the refrigerant circuit (20) from being condensed in the compressor (30). Further, in this aspect, during the time when the detection value of the outdoor air temperature detection means (72) decreases, the control means (91) keeps the heating means (80) stopping heating the compressor (30) even in the operation stop of the refrigerating apparatus (10).

In the state that the refrigerating apparatus (10) is stopped, each temperature change of the compressor (30) and the heat source side heat exchanger (34) is accompanied by temperature change of the outdoor air. Further, in general, the thermal capacity of the compressor (30) is larger than that of the heat source side heat exchanger (34) that performs heat exchange between the outdoor air and the refrigerant. For this reason, time lag from the temperature change of the outdoor air is longer in the temperature change of the compressor (30) than in the temperature change of the heat source side heat exchanger (34). Accordingly, in course of gradual temperature lowering of the outdoor air, for example, afternoon to night, the temperature of the heat source side heat exchanger (34) is almost equal to the outdoor air temperature while the temperature of the compressor (30) is slightly higher than the outdoor air temperature. In other words, during the time when the outdoor air temperature lowers gradually, the temperature of the compressor (30) is higher than that of the heat source side heat exchanger (34).

The refrigerant filled in the refrigerant circuit (20) is condensed and accumulates at a part of the refrigerant circuit (20) of which temperature is the lowest during the operation stop of the refrigerating apparatus (10). Accordingly, during the time when the outdoor air temperature lowers gradually, the refrigerant accumulates into the heat source side heat exchanger (34) of which temperature is lower than that of the compressor (30). From this state, it can be inferred that less amount of the refrigerant will accumulate into the compressor (30).

In view of the foregoing, the control means (91) in the first aspect of the present invention judges that less amount of the refrigerant will accumulate into the compressor (30) during the time when the detection value of the outdoor air temperature detection means (72) decreases, and keeps the heating means (80) stopping heating the compressor (30).

A second aspect of the present invention is directed to a refrigerating apparatus including a refrigerant circuit (20) which performs a refrigeration cycle by circulating refrigerant and which includes: a heat source side circuit (21) including a compressor (30) and a heat source side heat exchanger (34) and installed outdoors; and a user side circuit (22) including a user side heat exchanger (37) and installed indoors, the heat source side circuit (21) and the user side circuit (22) being connected to each other, and the heat source side heat exchanger (34) performing heat exchange between the refrigerant and outdoor air. Wherein, the refrigerating apparatus further includes: heating means (80) which heats the compressor (30) in operation stop of the refrigerating apparatus; outdoor air temperature detection means (72) which detects a temperature of the outdoor air; compressor temperature detection means (77) which detects a temperature of the compressor (30); and control means (91) which keeps the heating means (80) stopping heating the compressor (30) during the time when a detection value of the compressor temperature detection means (77) is larger than a detection value of the outdoor air temperature detection means (72) in the operation stop of the refrigerating apparatus.

In the second aspect of the present invention, the heating means (80) heats the compressor (30) in the operation stop of the refrigerating apparatus (10) to prevent the refrigerant in the refrigerant circuit (20) from being condensed in the compressor (30). Further, in this aspect, during the time when the detection value of the compressor temperature detection means (77) is larger than the detection value of the outdoor air temperature detection means (72), the control means (91) keeps the heating means (80) stopping heating the compressor (30) even in the operation stop of the refrigerating apparatus (10).

In the state that the refrigerating apparatus (10) is stopped, each temperature change of the compressor (30) and the heat source side heat exchanger (34) is accompanied by temperature change of the outdoor air. Further, the heat source side heat exchanger (34), which is a heat exchanger for performing heat exchange between the refrigerant and the outdoor air, has a large surface in contact with the outdoor air. Accordingly, it can be inferred that the temperature of the heat source side heat exchanger (34) is almost equal to the temperature of the outdoor air, that is, the outdoor air temperature during the operation stop of the refrigerating apparatus (10).

The refrigerant filled in the refrigerant circuit (20) is condensed and accumulates at a part of the refrigerant circuit (20) of which temperature is the lowest during the operation stop of the refrigerating apparatus (10). Accordingly, during the time when the temperature of the compressor (30) is lower than the outdoor air temperature, the refrigerant accumulates into the heat source side heat exchanger (34) of which temperature is lower than that of the compressor (30). From this state, it can be inferred that less amount of the refrigerant will accumulate into the compressor (30).

In view of the foregoing, the control means (91) in the second aspect of the present invention judges that less amount of the refrigerant will accumulate into the compressor (30) during the time when the detection value of the compressor temperature detection means (77) is higher than the detection value of the outdoor air temperature detection means (72), and keeps the heating means (80) stopping heating the compressor (30).

Referring to a third aspect of the present invention, in the first or second aspect, the refrigerating apparatus further includes: indoor air temperature detection means (75) which detects a temperature of indoor air, wherein the user side heat exchanger (37) performs heat exchange between the refrigerant and the indoor air, and the control means (91) keeps the heating means (80) stopping heating the compressor (30) during the time when a detection value of the indoor air temperature detection means (75) is smaller than the detection value of the outdoor air temperature detection means (72).

In the third aspect of the present invention, during the time when the detection value of the indoor air temperature detection means (75) is larger than the detection value of the outdoor air temperature detection means (72), the control means (91) keeps the heating means (80) stopping heating the compressor (30) even in the operation stop of the refrigerating apparatus (10).

As described above, the refrigerant filled in the refrigerant circuit (210) is condensed and accumulates at a part of the refrigerant circuit (20) of which temperature is the lowest during the operation stop of the refrigerating apparatus (10). Accordingly, in the state that the indoor air temperature is lower than the outdoor air temperature in the operation stop of the refrigerating apparatus (10), the refrigerant filled in the refrigerant circuit (20) accumulates into the user side circuit (22) provided indoors rather than the heat source side circuit (21) provided outdoors. From this state, it can be inferred that less amount of the refrigerant will accumulate into the heat source side circuit (21) including the compressor (30).

In view of the foregoing, the control means (91) in the third aspect of the present invention judges that less amount of the refrigerant will accumulate into the compressor (30) during the time when the detection value of the indoor air temperature detection means (75) is lower than the detection value of the outdoor air temperature detection means (72), and keeps the heating means (80) stopping heating the compressor (30).

A fourth aspect of the present invention is directed to a refrigerating apparatus including a refrigerant circuit (20) which performs a refrigeration cycle by circulating refrigerant and which includes: a heat source side circuit (21) including a compressor (30) and a heat source side heat exchanger (34) and installed outdoors; and a user side circuit (22) including a user side heat exchanger (37) and installed indoors, the heat source side circuit (21) and the user side circuit (22) being connected to each other, and the heat source side heat exchanger (34) performing heat exchange between the refrigerant and outdoor air. Wherein, the refrigerating apparatus further includes heating means (80) which heats the compressor (30) in operation stop of the refrigerating apparatus; heat exchanger temperature detection means (73) which detects a temperature of the heat source side heat exchanger (34); and control means (91) which keeps the heating means (80) stopping heating the compressor (30) during the time when a detection value of the heat exchanger temperature detection means (73) decreases in the operation stop of the refrigerating apparatus.

In the fourth aspect of the present invention, the heating means (80) heats the compressor (30) in the operation stop of the refrigerating apparatus (10) to prevent the refrigerant in the refrigerant circuit (20) from being condensed in the compressor (30). Further, in this aspect, during the time when the detection value of the heat exchanger temperature detection means (73) decreases, the control means (91) keeps the heating means (80) stopping heating the compressor (30) even in the operation stop of the refrigerating apparatus (10).

In the state that the refrigerating apparatus (10) is stopped, each temperature change of the compressor (30) and the heat source side heat exchanger (34) is accompanied by temperature change of the outdoor air. Further, in general, the thermal capacity of the compressor (30) is larger than that of the heat source side heat exchanger (34) that performs heat exchange between the outdoor air and the refrigerant. For this reason, time lag from the temperature change of outdoor air is longer in the temperature change of the compressor (30) than in the temperature change of the heat source side heat exchanger (34). Accordingly, in course of gradual temperature lowering of the outdoor air, for example, afternoon to night, the temperature of the heat source side heat exchanger (34) is almost equal to the outdoor air temperature while the temperature of the compressor (30) is slightly higher than the outdoor air temperature. In other words, during the time when the temperature of the heat source side heat exchanger (34) lowers gradually as the outdoor air temperature lowers, the temperature of the compressor (30) is higher than that of the heat source side heat exchanger (34).

The refrigerant filled in the refrigerant circuit (20) is condensed and accumulates at a part of the refrigerant circuit (20) of which temperature is the lowest during the operation stop of the refrigerating apparatus (10). Accordingly, during the time when the temperature of the heat source side heat exchanger (34) lowers gradually, the refrigerant accumulates into the heat source side heat exchanger (34) of which temperature is lower than that of the compressor (30). From this state, it can be inferred that less amount of the refrigerant will accumulate into the compressor (30).

In view of the foregoing, the control means (91) in the fourth aspect of the present invention judges that less amount of the refrigerant will accumulate into the compressor (30) during the time when the detection value of the heat exchanger temperature detection means (73) decreases, and keeps the heating means (80) stopping heating the compressor (30).

A fifth aspect of the present invention is directed to a refrigerating apparatus includes a refrigerant circuit (20) which performs a refrigeration cycle by circulating refrigerant and which includes: a heat source side circuit (21) including a compressor (30) and a heat source side heat exchanger (34) and installed outdoors; and a user side circuit (22) including a user side heat exchanger (37) and installed indoors, the heat source side circuit (21) and the user side circuit (22) being connected to each other, and the heat source side heat exchanger (34) performing heat exchange between the refrigerant and outdoor air.

Wherein, the refrigerating apparatus further includes: heating means (80) which heats the compressor (30) in operation stop of the refrigerating apparatus; heat exchanger temperature detection means (73) which detects a temperature of the heat source side heat exchanger (34); compressor temperature detection means (77) which detects a temperature of the compressor (30); and control means (91) which keeps the heating means (80) stopping heating the compressor (30) during the time when a detection value of the compressor temperature detection means (77) is larger than a detection value of the heat exchanger temperature detection means (73) in the operation stop of the refrigerating apparatus.

In the fifth aspect of the present invention, the heating means (80) heats the compressor (30) in the operation stop of the refrigerating apparatus (10) to prevent the refrigerant in the refrigerant circuit (20) from being condensed in the compressor (30). Further, in this aspect, during the time when the detection value of the compressor temperature detection means (77) is larger than the detection value of the heat exchanger temperature detection means (73), the control means (91) keeps the heating means (80) stopping heating the compressor (30) even in the operation stop of the refrigerating apparatus (10).

In the state that the refrigerating apparatus (10) is stopped, each temperature change of the compressor (30) and the heat source side heat exchanger (34) is accompanied by temperature change of the outdoor air. While, the refrigerant filled in the refrigerant circuit (20) is condensed and accumulates at a part of the refrigerant circuit (20) of which temperature is the lowest during the operation stop of the refrigerating apparatus (10). Accordingly, during the time when the temperature of the heat source side heat exchanger (34) is lower than the temperature of the compressor (30), the refrigerant accumulates into the heat source side heat exchanger (34). From this state, it can be inferred that less amount of the refrigerant will accumulate into the compressor (30).

In view of the foregoing, the control means (91) in the fifth aspect of the present invention judges that less amount of the refrigerant will accumulate into the compressor (30) during the time when the detection value of the compressor temperature detection means (77) is larger than the detection value of the heat exchanger temperature detection means (73), and keeps the heating means (80) stopping heating the compressor (30).

Referring to a sixth aspect of the present invention, in the fourth or fifth aspect, the refrigerating apparatus further includes indoor air temperature detection means (75) which detects a temperature of indoor air, wherein the user side heat exchanger (37) performs heat exchange between the refrigerant and the indoor air, and the control means (91) keeps the heating means (80) stopping heating the compressor (30) during the time when a detection value of the indoor air temperature detection means (75) is smaller than the detection value of the heat exchanger temperature detection means (73).

In the sixth aspect of the present invention, during the time when the detection value of the indoor air temperature detection means (75) is larger than the detection value of the heat exchanger temperature detection means (73), the control means (91) keeps the heating means (80) stopping heating the compressor (30) even in the operation stop of the refrigerating apparatus (10).

As described above, the refrigerant filled in the refrigerant circuit (20) is condensed and accumulates at a part of the refrigerant circuit (20) of which temperature is the lowest during the operation stop of the refrigerating apparatus (10). Accordingly, when the indoor air temperature is lower than the outdoor air temperature in the operation stop of the refrigerating apparatus (10), the refrigerant filled in the refrigerant circuit (20) accumulates into the user side circuit (22) provided indoors rather than the heat source side circuit (21) provided outdoors. From this state, it can be inferred that less amount of the refrigerant will accumulate into the heat source side circuit (21) including the compressor (30). As well, it can be inferred, as described above, that the temperature of the heat source side heat exchanger (34) is almost equal to the outdoor air temperature.

In view of the foregoing, the control means (91) in the sixth aspect of the present invention judges that less amount of the refrigerant will accumulate into the compressor (30) during the time when the detection value of the indoor air temperature detection means (75) is lower than the detection value of the heat exchanger temperature detection means (73), and keeps the heating means (80) stopping heating the compressor (30).

Referring to a seventh aspect of the present invention, in any one of the first to sixth aspects, the heating means (80) is an electric heater (55) mounted at the compressor (30).

In the seventh aspect of the present invention, the electric heater (55) serves as the heating means (80). When the electric heater (55) is conducted in the operation stop of the refrigerating apparatus (10), Joule heat is generated to heat the compressor (30).

Referring to an eighth aspect of the present invention, in any one of the first to sixth aspects, the compressor (30) is a hermetic compressor in which a compression mechanism (61) compressing the refrigerant and an electric motor (62) driving the compression mechanism (61) are accommodated in one casing (63), and the heating means (80) feeds electric current in an open phase state to the electric motor (62) to cause Joule heat at the electric motor (62) without causing rotation of the electric motor (62).

In the eight aspect of the present invention, the heating means (80) feeds the electric current in the open phase state to the electric motor (62). For example, in the case where the electric motor (62) of the compressor (30) is a three-phase motor (62), the heating means (80) supplies alternating current to the electric motor (62) with one of there phases of the current opened. When the electric motor (62) of the compressor (30) is conducted in the open phase state, the electric motor (62) generates Joule heat without rotating, so that the compressor (30) is heated by the Joule heat generated at the electric motor (62) in the casing (63).

Effects of the Invention

In the present invention, whether the current state is a state that the refrigerant will accumulate into the heat source side heat exchanger (34) more than the compressor (30) is judged during the operation stop of the refrigerating apparatus (10). When the current state is judged to be such the state, the heating means (80) is kept stopping heating the compressor (30). In other words, in the present invention, when it is inferred that less amount of the refrigerant will accumulate into the compressor (30), the heating means (80) is inhibited from heating the compressor (30) even in the operation stop of the refrigerating apparatus (10). Accordingly, the present invention prevents the compressor (30) from being heated under the state where less amount of the refrigerant will accumulate into the compressor (30), thereby reducing energy required for heating the compressor (30) during the operation stop of the refrigerating apparatus (10). As a result, the present invention reduces energy consumption by the refrigerating apparatus (10) during the operation stop thereof.

Moreover, in the third and sixth aspects of the present invention, whether the current state is a state that the refrigerant will accumulate into the user side circuit (22) more than the heat source side circuit (21) is judged during the operation stop of the refrigerating apparatus (10). When the current state is judged to be such the state, the heating means (80) is kept stopping heating the compressor (30). In other words, in these aspects, when it is inferred that less amount of the refrigerant will accumulate into the heat source side circuit (21) including the compressor (30), the heating means (80) is inhibited from heating the compressor (30) even in the operation stop of the refrigerating apparatus (10). Hence, according to these aspect of the present invention, unnecessary heating of the compressor (30) is avoided further definitely to suppress energy consumption of the refrigerating apparatus (10) during the operation stop thereof further low.

EXPLANATION OF REFERENCE NUMERALS

Figure 1:
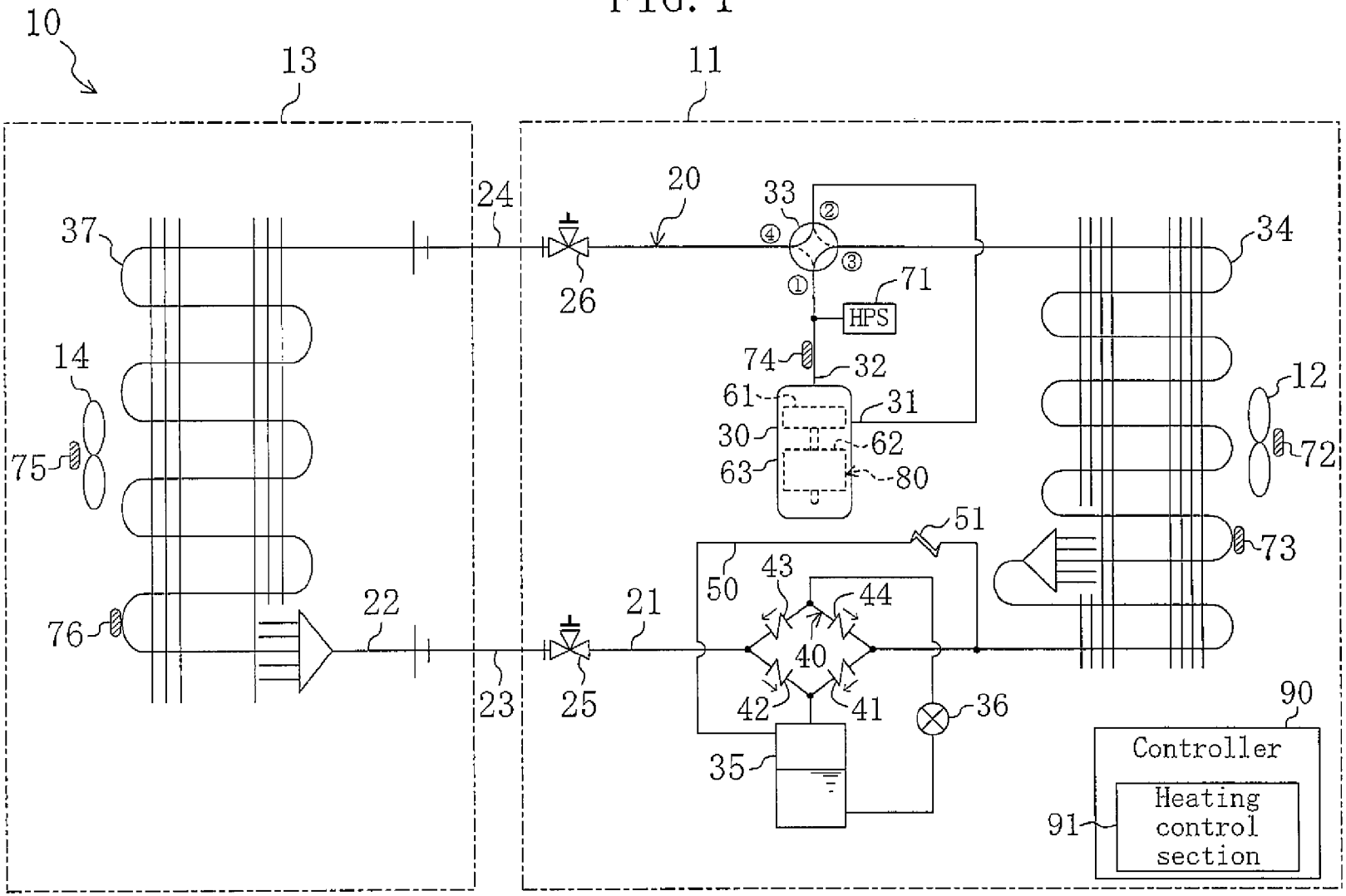
FIG. 1 is a refrigerant circuit diagram showing a construction of an air conditioner in accordance with Embodiment 1.

10 air conditioner (refrigerating apparatus)
20 refrigerant circuit
21 outdoor circuit (heat source side circuit)
22 indoor circuit (user side circuit)
30 compressor
34 outdoor heat exchanger (heat source side heat exchanger)
37 indoor heat exchanger (user side heat exchanger)
55 electric heater
61 compression mechanism
62 electric motor
63 casing
72 outdoor air temperature sensor (outdoor air temperature detection means)
73 outdoor heat exchanger temperature sensor (heat exchanger temperature detection means)
75 indoor air temperature sensor (indoor air temperature detection means)
77 compressor temperature sensor (compressor temperature detection means)
80 heating means
91 heating control section (control means)

BEST MODE FOR CARRYING OUT THE INVENTION

Embodiments of the present invention will be described in detail with reference to the accompanying drawings.

Embodiment 1

Embodiment 1 of the present invention will be described. The present embodiment refers to an air conditioner (10) composed of a refrigerating apparatus in accordance with the present invention.

As shown in FIG. 1, the air conditioner (10) includes a refrigerant circuit (20). The refrigerant circuit (20) is composed of an outdoor circuit (21) serving as a heat source side circuit, an indoor circuit (22) serving as a user side circuit, a liquid side communication pipe (23), and a gas side communication pipe (24). The outdoor circuit (21) is accommodated in an outdoor unit (11) installed outdoors. The outdoor unit (11) is provided with an outdoor fan (12). On the other hand, the indoor circuit is accommodated in an indoor unit (13) installed indoors. The indoor unit (13) is provided with an indoor fan (14).

The outdoor circuit (21) includes a compressor (30), a four-way switching valve (33), an outdoor heat exchanger (34), a receiver (35), and a motor-operated expansion valve (36). The outdoor circuit (21) further includes a bridge circuit (40), a liquid side closing valve (25), and a gas side closing valve (26).

In the outdoor circuit (21), a discharge pipe (32) of the compressor (30) is connected to the first port of the four-way switching valve (33). A high-pressure pressure switch (71) is provided at a pipe connecting together the discharge pipe (32) of the compressor (30) and the four-way switching valve (33). A suction pipe (31) of the compressor (30) is connected to the second port of the four-way switching valve (33). The third port of the four-way switching valve (33) is connected to one end of the outdoor heat exchanger (34). The other end of the outdoor heat exchanger (34) is connected to the bridge circuit (40). The receiver (35), the motor-operated expansion valve (36), and the liquid side closing valve (25) are connected to the bridge circuit (40). This point will be described later. The fourth port of the four-way switching valve (33) is connected to the gas side closing valve (26).

The bridge circuit (40) includes four check valves (41 to 44). In the bridge circuit (40): the outflow side of the first check valve (41) is connected to the outflow side of the second check valve (42); the inflow side of the second check valve (42) is connected to the outflow side of the third check valve (43); the inflow side of the third check valve (43) is connected to the inflow side of the fourth check valve (44); and the outflow side of the fourth check valve (44) is connected to the inflow side of the first check valve (41).

The other end of the outdoor heat exchanger (34) is connected between the first check valve (41) and the fourth check valve (44) of the bridge circuit (40). The liquid side closing valve (25) is connected between the second check valve (42) and the third check valve (43) of the bridge circuit (40).

The receiver (35) is a member in a form of an oblong cylindrical sealed container. The upper end of the receiver (35) is connected between the first check valve (41) and the second check valve (42) of the bridge circuit (40). The lower end of the receiver (35) is connected between the third check valve (43) and the fourth check valve (44) of the bridge circuit (40) via the motor-operated expansion valve (36).

The outdoor circuit (21) includes an equalizing pipe (50). The equalizing pipe (50) is connected at one end thereof to the receiver (35) while being connected at the other end thereof between the outdoor heat exchanger (34) and the bridge circuit (40). The equalizing pipe (50) includes a capillary tube (51).

The indoor circuit (22) includes an indoor heat exchanger (37). The indoor circuit (22) is connected at one end thereof to the liquid side closing valve (25) through the liquid side communication pipe (23) while being connected at the other end thereof to the gas side closing valve (26) through the gas side communication pipe (24). After the thus constructed air conditioner (10) is installed, the liquid side closing valve (25) and the gas side closing valve (26) are opened all the time.

The compressor (30) is a high-pressure dome type hermetic compressor. Specifically, in the compressor (30), a compression mechanism (61) as a scroll type fluid machinery and an electric motor (62) that drives the compression mechanism (61) are accommodated in a casing (63) in a form of an oblong cylindrical sealed container. Refrigerant sucked from the suction pipe (31) is introduced directly into the compression mechanism (61). The refrigerant compressed in the compression mechanism (61) is discharged once into the casing (63) and is then sent out from the discharge pipe (32).

The electric motor (62) of the compressor (30) is composed of a three-phase synchronous electric motor as one kind of an alternating-current motor (62). To the electric motor (62), electric power is supplied through an inverter not shown. Change of the output frequency of the inverter changes the number of rotation of the electric motor (62) to change the capacity of the compressor (30).

The outdoor heat exchanger (34) and the indoor heat exchanger (37) are fin-and-tube heat exchangers of cross-fin type. The outdoor heat exchanger (34) serves as a heat source side heat exchanger for performing heat exchange between the refrigerant in the refrigerant circuit (20) and the outdoor air supplied by the outdoor fan (12). On the other hand, the indoor heat exchanger (37) serves as a user side heat exchanger for performing heat exchange between the refrigerant in the refrigerant circuit (20) and the indoor air supplied by the indoor fan (14).

The four-way switching valve (33) switches the state between a state indicated by solid lines in FIG. 1 and a state indicated by the broken lines in FIG. 1, wherein the state indicated by the solid lines is a state that the first port and the third port communicate with each other while the second port and the fourth port communicate with each other, and the state indicated by the broken line is a state that the first port and the fourth port communicate with each other while the second port and the third port communicate with each other.

The air conditioner (10) includes various kinds of temperature sensors. The detection values of the temperature sensors are input to a controller (90) to be used for controlling the operation of the air conditioner (10).

Specifically, an outdoor air temperature sensor (72) is provided at the outdoor unit (11) for detecting the temperature of the outdoor air. The outdoor air temperature sensor (72) serves as outdoor air temperature detection means. An outdoor heat exchanger temperature sensor (73) is provided at the outdoor heat exchanger (34) for detecting the temperature of the heat transfer tube thereof. The outdoor heat exchanger temperature sensor (73) serves as outdoor heat exchanger temperature detection means. A discharge pipe temperature sensor (74) is provided at the discharge pipe (32) of the compressor (30) for detecting the temperature of the refrigerant discharged from the compressor (30). An indoor air temperature sensor (75) is provided at the indoor unit (13) for detecting the temperature of the indoor air. The indoor air temperature sensor (75) serves as indoor air temperature detection means. An indoor heat exchanger temperature sensor (76) is provided at the indoor heat exchanger (37) for detecting the temperature of the heat transfer tube thereof. The indoor heat exchanger temperature sensor (76) serves as indoor heat exchanger temperature detection means.

The air conditioner (10) of the present embodiment includes the controller (90). The controller (90) performs capacity control of the compressor (30), opening control of the motor-operated expansion valve (36), and the like on the basis of the detection values obtained from the associated temperature sensors.

The controller (90) includes a heating control section (91). The heating control section (91) is composed so as to feed electric current in an open phase state to the electric motor (62) of the compressor (30) in the operation stop of the air conditioner (10), namely, in the time when the power source of the air conditioner (10) is turned off through input from a remote controller or the like. Specifically, the heating control section (91) supplies alternating current in a one-phase opening state. The conduction in the open phase state of the electric motor (62) allows the electric current to flow into the coil of the electric motor (62) without causing rotation of the electric motor (62), thereby generating Joule heat. Thus, in the air conditioner (10) of the present embodiment, a combination of the heating control section (91) and the electric motor (62) of the compressor (30) forms heating means (80).

Further, the heating control section (91) serves as control means for judging whether to feed the electric current to the electric motor (62) in the operation stop of the air conditioner (10) on the basis of the detection value of the outdoor air temperature sensor (72). This operation of the heating control section (91) will be described later.

—Driving Operation of Air Conditioner—

A driving operation of the air conditioner (10) will be described. The air conditioner (10) performs, by switching, a cooling operation for cooling the indoor air by the indoor heat exchanger (37) or a hating operation for heating the indoor air by the indoor heat exchanger (37).

<Cooling Operation>

In the cooling operation, the four-way switching valve (33) is switched to the state indicated by the solid lines in FIG. 1 and the motor-operated expansion valve (36) is adjusted at a predetermined opening. Further, the outdoor fan (12) and the indoor fan (14) are operated. Under this state, the refrigerant circuit (20) circulates the refrigerant to perform a refrigeration cycle.

The refrigerant discharged from the compressor (30) releases heat to the outdoor air to be condensed in the outdoor heat exchanger (34) and then flows into the receiver (35) via the first check valve (41) of the bridge circuit (40). The refrigerant flowing out from the receiver (35) is decompressed when flowing through the motor-operated expansion valve (36), flows through the third check valve (43) of the bridge circuit (40) and the liquid side communication pipe (23), and then flows into the indoor heat exchanger (37).

In the indoor heat exchanger (37), the refrigerant absorbs heat from the indoor air to be evaporated. The indoor air taken into the indoor unit (13) is cooled in the indoor heat exchanger (37) and is then sent back indoors. The refrigerant evaporated in the indoor heat exchanger (37) flows through the gas side communication pipe (24) and the four-way switching valve (33) sequentially and is then sucked into the compressor (30). The compressor (30) compresses and then discharges the sucked refrigerant.

<Heating Operation>

In the heating operation, the four-way switching valve (33) is switched to the state indicated by the broken lines in FIG. 1 and the motor-operated expansion valve (36) is adjusted at a predetermined opening. Further, the outdoor fan (12) and the indoor fan (14) are operated. Under this state, the refrigerant circuit (20) circulates the refrigerant to perform a refrigeration cycle.

The refrigerant discharged from the compressor (30) flows through the four-way switching valve (33) and the gas side communication pipe (24) and then flows into the indoor heat exchanger (37). In the indoor heat exchanger (37), the refrigerant releases heat to the indoor air to be condensed. The indoor air taken into the indoor unit (13) is heated in the indoor heat exchanger (37) and is then sent back indoors.

The refrigerant condensed in the indoor heat exchanger (37) flows through the liquid side communication pipe (23) and the second check valve (42) of the bridge circuit (40) sequentially and then flows into receiver (35). The refrigerant flowing out from the receiver (35) is decompressed when flowing through the motor-operated expansion valve (36), flows through the fourth check valve (44) of the bridge circuit (40), and then flows into the outdoor heat exchanger (34). The refrigerant flowing in the outdoor heat exchanger (34) absorbs heat from the outdoor air to be evaporated and is then sucked into the compressor (30). The compressor (30) compresses and then discharges the sucked refrigerant.

—Control Operation of Heating Control Section—

In the operation stop of the air conditioner (10), the heating control section (91) of the controller (90) feeds the electric current in the open phase state to the electric motor (62) of the compressor (30) for heating the compressor (30).

During the operation stop of the air conditioner (10), the refrigerant in the refrigerant circuit (20) is condensed and accumulates at a part of the refrigerant circuit (20) of which temperature is the lowest. Therefore, liquid refrigerant accumulates in the casing (63) of the compressor (30) in some cases.

The compressor (30) is a hermetic compressor and therefore stores refrigeration oil in the casing (63) thereof. During the operation of the compressor (30), the refrigeration oil stored in the casing (63) is supplied to the compression mechanism (61) to be utilized for lubrication. When the refrigerant accumulates into the casing (63) in operation stop of the compressor (30), the refrigerant is mixed with the refrigeration oil to lower the viscosity of the refrigeration oil. When the compressor (30) is activated in this state, the refrigeration oil having low viscosity is supplied to the compression mechanism (61) to invite trouble, such as seizing. Further, the refrigeration oil mixed with the refrigeration oil is evaporated abruptly to make the refrigeration oil to be in a foamy state, inviting insufficient supply of the refrigeration oil to the compression mechanism (61).

In view of the foregoing, the heating control section (91) feeds the electric current in the open phase state to the electric motor (62) of the compressor (30) in the operation stop of the air conditioner (10). Conduction in the open phase state of the electric motor (62) of the compressor (30) causes the electric current to flow into the coil of the electric motor (62) to generate Joule heat without causing rotation of the electric motor (62). The thus generated Joule heat heats the compressor (30). As a result, the amount of the refrigerant accumulating in the compressor (30) in the operation stop of the air conditioner (10) and mixed with the refrigeration oil is reduced to suppress lowering of the viscosity of the refrigeration oil.

Further, the heating control section (91) judges whether to feed the electric current to the electric motor (62) during the operation stop of the air conditioner (10) on the basis of the detection value of the outdoor air temperature (72). This operation of the heating control section (91) will be described.

When the air conditioner (10) is stopped, the heating control section (91) monitors the detection value of the outdoor air temperature sensor (72), that is, the outdoor air temperature. Specifically, the heating control section (91) samples the detection value of the outdoor air temperature sensor (72) every predetermined time and compares the latest detection value $T_0$, that is, the current outdoor air temperature and the previous detection value $T_1$, that is, the outdoor air temperature before the predetermined period. The heating control section (91) stops feeding the electric current to the electric motor (62) of the compressor (30) during the time when the latest detection value is smaller than the previous detection value, namely, during the time when $T_0<T_1$, while feeding the electric current in the open phase state to the electric motor (62) of the compressor (30) during the time when the latest detection value is equal to or larger than the previous detection value, namely, during the time when $T_0 \geq T_1$. In other words, the heating control section (91) keeps the electric motor (62) of the compressor (30) not being conducted during the time when the detection value of the outdoor air temperature sensor (72) lowers while allowing the electric motor (62) of the compressor (30) to be conducted during the time when the detection value of the outdoor air temperature sensor (72) is constant or increases.

In the intermediate seasons, such as spring and autumn, the air conditioner (10) may be stopped all day long. Description will be given about an operation of the heating control section (91) in the case where the air conditioner (10) is stopped all day long in such a season as an example.

Figure 2:
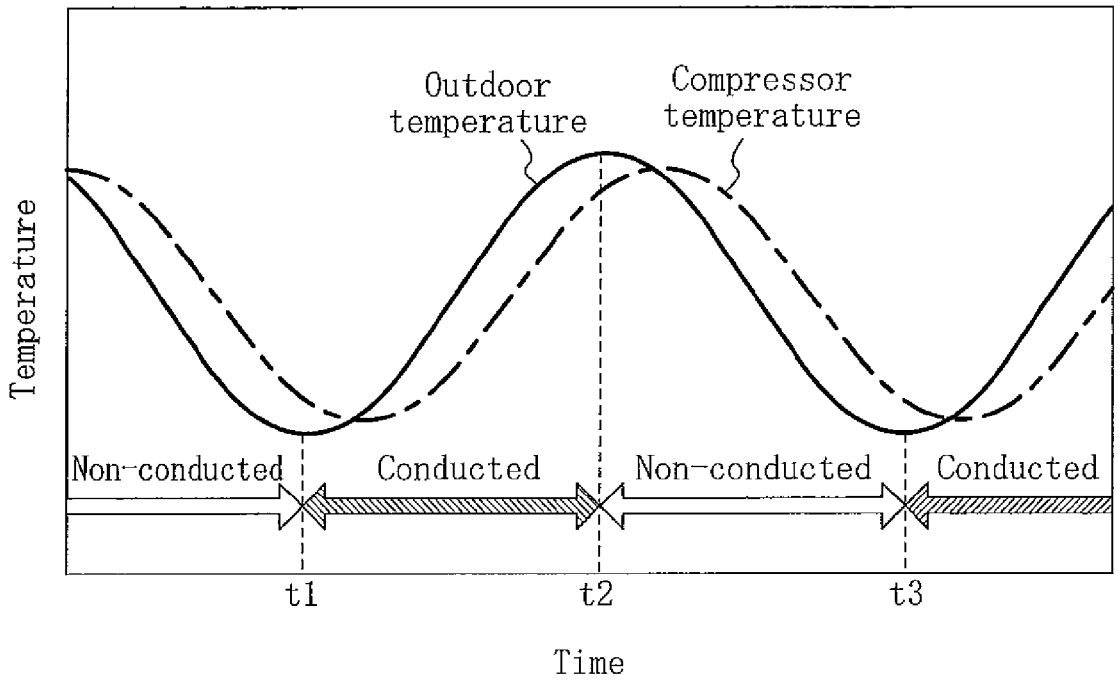
FIG. 2 is a graph showing the relationship between time and temperature for explaining a control operation that a heating control section performs in accordance with Embodiment 1.

The outdoor air temperature changes substantially periodically, as indicated by the solid line in FIG. 2. Specifically, the outdoor air temperature lowers gradually from afternoon to night while increasing gradually from night to afternoon.

The outdoor heat exchanger (34), which is a heat exchanger for performing heat exchange between the refrigerant and the outdoor air, has a large surface in contact with the outdoor air. Further, the outdoor heat exchanger (34) is generally formed of members made of metal having comparatively high thermal conductivity, such as aluminum, copper, or the like, and is, therefore, comparatively small in thermal capacity. Accordingly, the temperature of the outdoor heat exchanger (34) changes substantially synchronously with temperature change of the outdoor air. In other words, the temperature of the outdoor heat exchanger (34) is almost equal to the outdoor air temperature.

On the other hand, the mass of the compressor (30) is rather larger than that of the outdoor heat exchanger (34) while the surface area of the compressor (30) is rather smaller than that of the outdoor heat exchanger (34). Further, the members composing the compressor (30) are generally made of steel, cast iron, or the like having comparatively low thermal conductivity. Accordingly, it is general that the thermal capacity of the compressor (30) is rather larger than that of the outdoor heat exchanger (34). Further, the compressor (30) is covered with an heat insulator, such as glass wool or the like in many cases. Accordingly, the temperature of the compressor (30) changes with a time lag from the temperature change of the outdoor air, as indicated by the one-dot chain line in FIG. 2. Specifically, the temperature of the compressor (30) is higher than the temperature of the outdoor heat exchanger (34), which is nearly equal to the outdoor air temperature, during the time when the outdoor air temperature lowers gradually.

As described above, in the operation stop of the air conditioner (10), the refrigerant in the refrigerant circuit (20) accumulates into a part of the refrigerant circuit (20) of which temperature is the lowest. Accordingly, during the time when the outdoor air temperature lowers gradually, the refrigerant accumulates into the outdoor heat exchanger (34) of which temperature is lower than the compressor (30). This means that: during the time when the outdoor air temperature lowers gradually, less amount of the refrigerant accumulates into the compressor (30) even if the compressor (30) is not heated. In view of this, the heating control section (91) keeps the electric motor (62) of the compressor (30) not being conducted until the time t1 in FIG. 2.

Since the temperature change of the compressor (30) follows the temperature change of the outdoor air with a time lag, the temperature of the compressor (30) is lower than the temperature of the outdoor heat exchanger (34), which is nearly equal to the outdoor air temperature. In this state, the refrigerant in the refrigerant circuit (20) might accumulate into the compressor (30) rather than the outdoor heat exchanger (34), and therefore, the heating control section (91) feeds the electric current in the open phase state to the electric motor (62) of the compressor (30). In the example shown in FIG. 2, the heating control section (91) starts feeding the electric current to the electric motor (62) of the compressor (30) at the time t1, and keeps conduction of the electric motor (62) of the compressor (30) during the time when the outdoor air temperature increases. When the outdoor air temperature starts lowering again at the time t2, the heating control section stops feeding the electric current to the electric motor (62) of the compressor (30).

In the case where the power source of the air conditioner (10) is turned on when the electric motor (62) of the compressor (30) is conducted in the open phase state, the heating control section (91) immediately stops feeding the electric current in the open phase state to the electric motor (62) of the compressor (30). Then, the controller (90) starts supplying the three-phase alternating current to the electric motor (62) of the compressor (30) to cause the electric motor (62) to drive the compression mechanism (61), thereby starting the refrigeration cycle of the refrigerant circuit.

Effects of Embodiment 1

In the present embodiment, it is judged, during the operation stop of the air conditioner (10), whether the current state is a state where the refrigerant will accumulate into the outdoor heat exchanger (34) more than the compressor (30). When the current state is such the state, the heating control section (91) keeps on stopping feeding the electric current to the electric motor (62) of the compressor (30). Specifically, in the present embodiment, when it is inferred that less amount of the refrigerant will accumulate into the compressor (30), feeding of the electric current in the open phase state to the electric motor (62) of the compressor (30) is stopped even in the operation stop of the air conditioner (10). In the present embodiment, hence, the compressor (30) is prevented from being heated unnecessarily in a state that less amount of the refrigerant will accumulate thereinto even without heating the compressor (30), thereby reducing the electric power required for heating the compressor (30) in the operation stop of the air conditioner (10). Thus, according to the present embodiment, power consumption in the operation stop of the air conditioner (10), generally called standby energy, is reduced.

Modified Example 1 of Embodiment 1

The heating control section (91) in the present embodiment may judge whether the electric motor (62) of the compressor (30) should be conducted on the basis of the detection value of the outdoor heat exchanger temperature sensor (73) in the place of the detection value of the outdoor air temperature sensor (72).

During the operation stop of the air conditioner (10), the heating control section (91) in the present modified example monitors the detection value of the outdoor heat exchanger temperature sensor (73). The heating control section (91) stops feeding the electric current in the open phase state to the electric motor (62) of the compressor (30) during the time when the detection value of the outdoor heat exchanger temperature sensor (73) decreases while feeding the electric current in the open phase state to the electric motor (62) of the compressor (30) during the time when the detection value of the outdoor heat exchanger temperature sensor (73) is constant or increases.

As described above, the temperature of the outdoor heat exchanger (34) is almost equal to the outdoor air temperature during the operation stop of the air conditioner (10). Accordingly, gradual temperature lowering of the outdoor heat exchanger (34) means gradual temperature lowering of the outdoor air, and therefore, it can be inferred that the temperature of the compressor (30) is higher than the temperature of the outdoor heat exchanger (34) under such the state. In view of this, the heating control section (91) in the present modified example judges that less amount of refrigerant will accumulate into the compressor (30) during the time when the temperature of the outdoor heat exchanger (34) lowers gradually, and keeps on stopping feeding the electric current to the electric motor (62) of the compressor (30), thereby eliminating unnecessary power consumption.

Modified Example 2 of Embodiment 1

The heating control section (91) in the present embodiment may stop feeding the electric current to the electric motor (62) of the compressor (30) during the time when the latest detection value is equal to or smaller than the previous detection value (during the time when $T_0 \leq T_1$) while feeding the electric current in the open phase state to the electric motor (62) of the compressor (30) during the time when the latest detection value is larger than the previous detection value (during the time when $T_0 > T_1$). In other words, the heating control section (91) in the present modified example keeps on stopping feeding the electric current to the electric motor (62) of the compressor (30) during the time when the detection value of the outdoor air temperature sensor (72) decreases or is constant while feeding the electric current to the electric motor (62) of the compressor (30) during the time when the detection value of the outdoor air temperature sensor (73) increases.

Embodiment 2

Embodiment 2 of the present invention will be described. Herein, only difference of an air conditioner (10) of the present embodiment from that of Embodiment 1 will be described.

Figure 3:
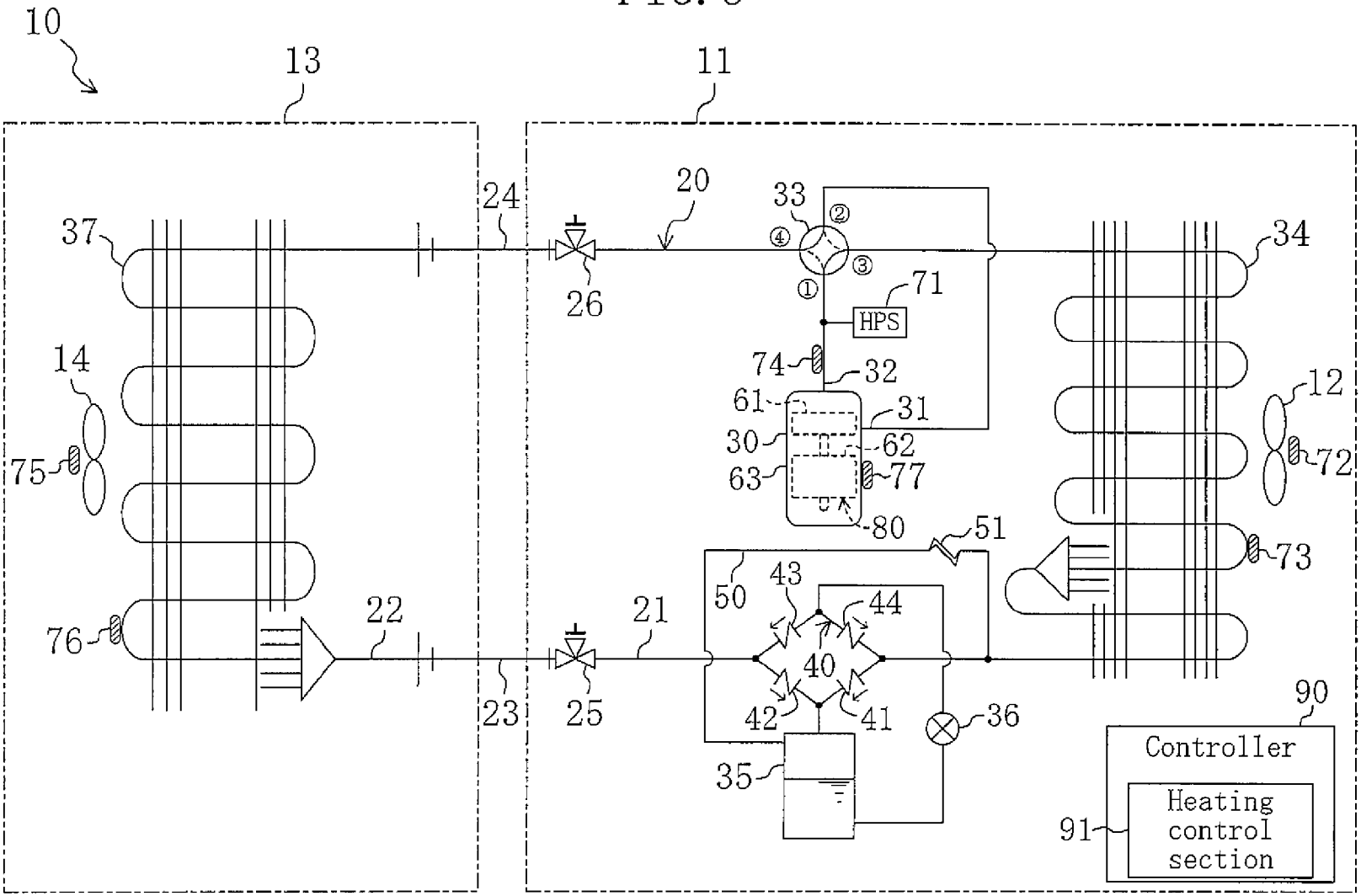
FIG. 3 is a refrigerant circuit diagram showing a construction of an air conditioner in accordance with Embodiment 2.

In the air conditioner (10) of the present invention, as shown in FIG. 3, the compressor temperature sensor (77) is mounted at the casing (63) of the compressor (30). The compressor temperature sensor (77) serves as compressor temperature detection means for detecting the temperature of the compressor (30).

The heating control section (91) in the present embodiment judges, during the operation stop of the air conditioner (10), whether to feed the electric current to the electric motor (62) on the basis of the detection value of the outdoor air temperature sensor (72) and the detection value of the compressor temperature sensor (77). This operation of the heating control section (91) will be described.

When the air conditioner (10) is stopped, the heating control section (91) monitors the detection value of the outdoor air temperature sensor (72), that is, the outdoor air temperature and the detection value of the compressor temperature sensor (77), that is, the temperature of the compressor (30). Specifically, the heating control section (91) samples every predetermined time and compares the detection value $T_{OA}$ of the outdoor air temperature sensor (72) and the detection value $T_C$ of the compressor temperature sensor (77). Then, the heating control section (91) stops feeding the electric current to the electric motor (62) of the compressor (30) during the time when the detection value $T_{OA}$ of the outdoor air temperature sensor (72) is smaller than the detection value $T_C$ of the compressor temperature sensor (77), namely, during the time when $T_{OA} < T_C$ while feeding the electric current in the open phase state to the electric motor (62) of the compressor (30) during the time when the detection value $T_{OA}$ of the outdoor air temperature sensor (72) is equal to or larger than the detection value $T_C$ of the compressor temperature sensor (77), namely during the time when $T_{OA} \geq T_C$.

In the intermediate seasons, such as spring and autumn, the air conditioner (10) may be stopped all day long. Description will be given about an operation of the heating control section (91) in the case where the air conditioner (10) is stopped all day long in such a season as an example.

Figure 4:
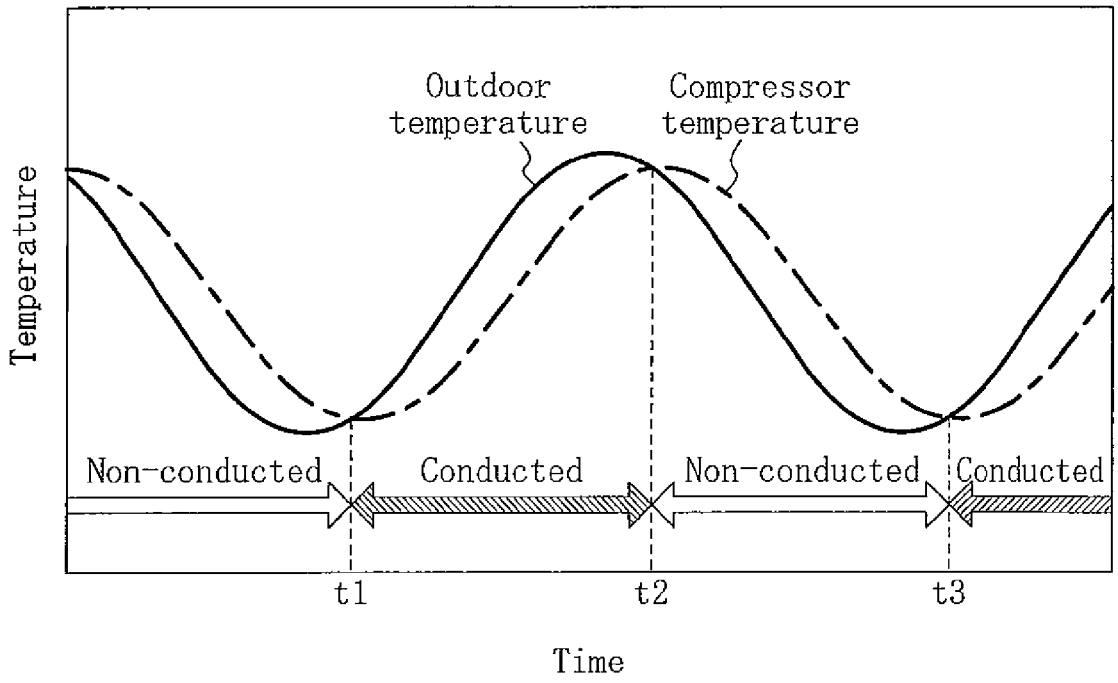
FIG. 4 is a graph showing the relationship between time and temperature for explaining a control operation that a heating control section performs in accordance with Embodiment 2.

As indicated by the solid line in FIG. 4, the outdoor air temperature changes substantially periodically. The temperature of the outdoor heat exchanger (34), which has comparatively small thermal capacity and a large surface in contact with the outdoor air, is almost equal to the outdoor air temperature. While, in the outdoor circuit (21), the refrigerant accumulates into a lower-temperature one out of the outdoor heat exchanger (34) and the compressor (30) during the operation stop of the air conditioner (10). In view of this, the heating control section (91) keeps on stopping feeding the electric current to the electric motor (62) of the compressor (30) until the time t1 in FIG. 4.

When the temperature of the compressor (30) becomes equal to the temperature of the outdoor heat exchanger (34) at the time t1, the heating control section (91) starts feeding the electric current in the open phase state to the electric motor (62) of the compressor (30). During the time when the outdoor air temperature gradually increases thereafter, the temperature of the compressor (30) is lower than the temperature of the outdoor heat exchanger (34), and accordingly, the heating control section (91) keeps feeding the electric current to the electric motor (62) of the compressor (30). When the temperature of the compressor (30) exceeds the temperature of the outdoor heat exchanger (34) at the time t2, the heating control section (91) stops feeding the electric current to the electric motor (62) of the compressor (30).

In this way, the heating control section (91) in the present embodiment feeds the electric current in the open phase state to the electric motor (62) of the compressor (30) only during the time when it is inferred that much amount of the refrigerant will accumulate into the compressor (30) of the outdoor circuit (21). According to the present embodiment, hence, unnecessary heating of the compressor, (30) can be avoided and the electric power, that is, standby energy consumed in the operation stop of the air conditioner (10) can be reduced, similarly to the case of Embodiment 1.

Modified Example 1 of Embodiment 2

The heating control section (91) in the present embodiment may judge whether to feed the electric current to the electric motor (62) of the compressor (30) on the basis of the detection value of the outdoor heat exchanger temperature sensor (73) in the place of the detection value of the outdoor air temperature sensor (72).

During the operation stop of the air conditioner (10), the heating control section (91) in the present modified example monitors the detection value of the outdoor heat exchanger temperature sensor (73) and the detection value of the compressor temperature sensor (77). Then, the heating control section (91) stops feeding the electric current in the open phase state to the electric motor (62) of the compressor (30) during the time when the detection value of the compressor temperature sensor (77) exceeds the detection value of the outdoor hear exchanger temperature sensor (73) while feeding the electric current in the open phase state to the electric motor (62) of the compressor (30) during the time when the detection value of the compressor temperature sensor (77) is equal to or smaller than the detection value of the outdoor heat exchanger temperature sensor (73).

As described above, in the outdoor circuit (21), the refrigerant accumulates into a lower-temperature one out of the outdoor heat exchanger (34) and the compressor (30) during the operation stop of the air conditioner (10). In view of this, the heating control section (91) in the present modified example judges that less amount of refrigerant will accumulate into the compressor (30) during the time when the detection value of the compressor temperature sensor (77) exceeds the detection value of the outdoor heat exchanger temperature sensor (73), and keeps on stopping feeding the electric current to the electric motor (62) of the compressor (30), thereby avoiding unnecessary power consumption.

Other Embodiment

The above embodiments may have any of the following arrangement.

First Modified Example

In each of the above embodiments, the compressor (30) is heated by feeding the electric current in the open phase state to the electric motor (62) of the compressor (30). In the place thereof, an electric heater (55) may be mounted at the compressor (30) so that the compressor (30) is heated by feeding the electric current to the electric heater (55). In this modified example, a combination of the electric heater (55) and the heating control section (91) of the controller (90) serves as the heating means (80).

Figure 5:
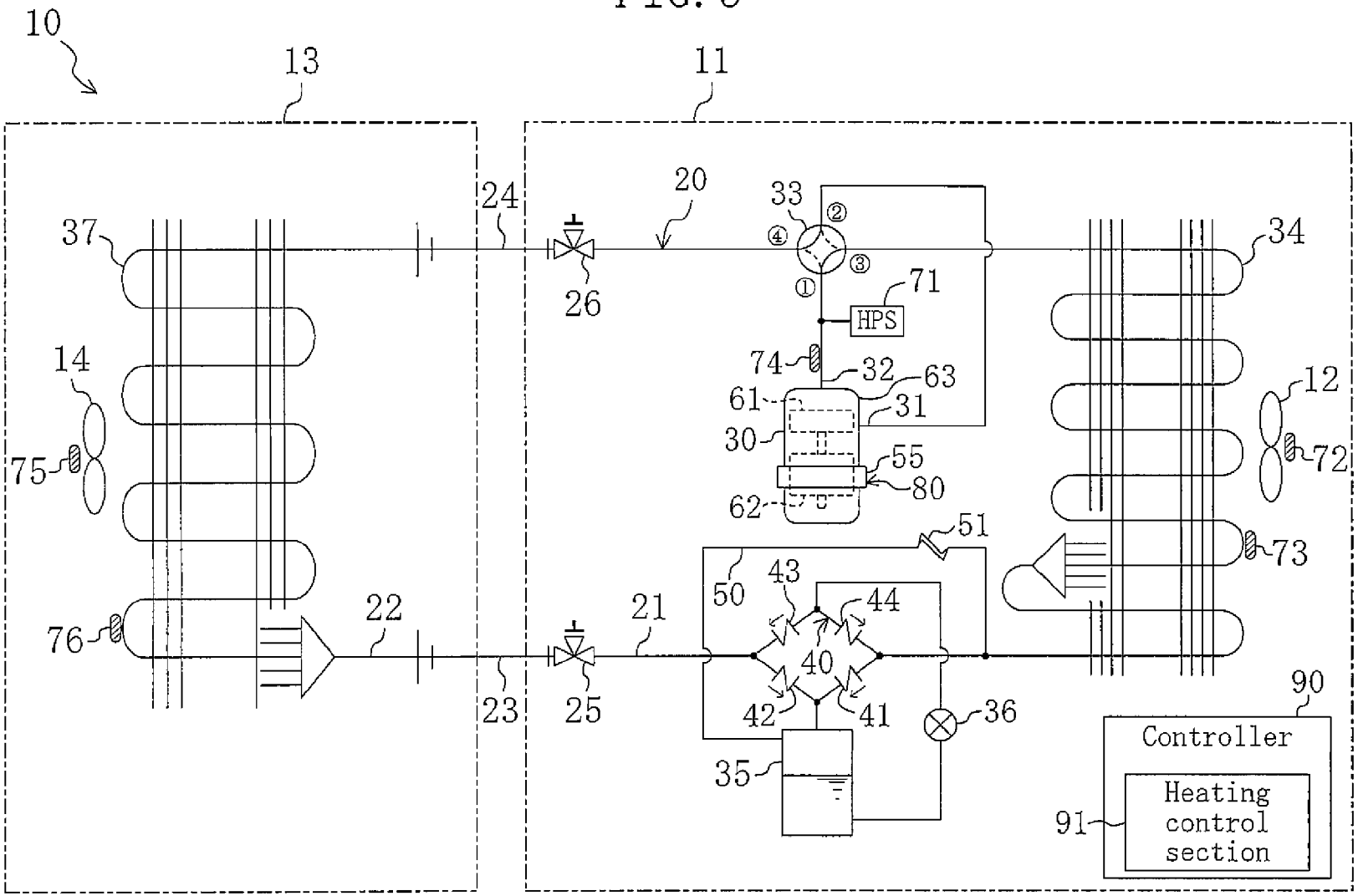
FIG. 5 is a refrigerant circuit diagram showing a construction of an air conditioner in accordance with the first modified example in other embodiments.

As shown in FIG. 5, the electric heater (55) is wound around the lower part of the casing (63) of the compressor (30). When the electric heater (55) is conducted, Joule heat is generated to heat the compressor (30). In the present modified example, the heating control section (91) of the controller (90) supplies electric power to the electric heater (55) in the operation stop of the air conditioner (10).

As described above, each heating control section (91) in the above embodiments judges whether to heat the compressor (30) in the operation stop of the air conditioner (10) on the basis of the tendency for change in the detection value of the outdoor air temperature sensor (72), the relationship between the detection value of the outdoor air temperature sensor (72) and the detection value of the compressor temperature sensor (77), or the like. The heating control section (91) in the present modified example performs the same judgment as in any of the above embodiments and feeds the electric current to the electric heater (55) when heating of the compressor (30) is judged necessary in the operation stop of the air conditioner (10).

Second Modified Example

In Embodiments 1 and 2 and the first modified example, the heating control section (91) of the controller (90) may take account of the detection value of the indoor air temperature sensor (75) for judging whether to heat the compressor (30) in the operation stop of the air conditioner (10).

Specifically, the heating control section (91) in present modified example compares the detection value of the indoor air temperature sensor (75) and the detection value of the outdoor air temperature sensor (72) during the operation stop of the air conditioner (10), and keeps on stopping heating the compressor (30) during the time when the detection value of the outdoor air temperature sensor (72) is equal to or larger than the detection value of the indoor air temperature sensor (75), as well.

For example, in the case where the present modified example is applied to Embodiment 1, the heating control section (91) keeps on stopping feeding the electric current in the open state to the electric motor (62) of the compressor (30) during the time when either first or second condition is met in the operation stop of the air conditioner (10), wherein the first condition is such that the detection value of the indoor air temperature sensor (75) is smaller than the detection value of the outdoor air temperature sensor (72) and the second condition is such that the detection value of the outdoor sensor (72) decreases.

As well, in the case where the present modified example is applied to Embodiment 2, the heating control section (91) keeps on stopping feeding the electric current in the open state to the electric motor (62) of the compressor (30) when either first or second condition is met in the operation stop of the air conditioner (10), wherein the first condition is such that the detection value of the indoor air temperature sensor (75) is smaller than the detection value of the outdoor air temperature sensor (72) and the second condition is such that the detection value of the outdoor air temperature sensor (72) is smaller than the detection value of the compressor temperature sensor (77).

As described above, during the operation stop of the air conditioner (10), the refrigerant in the refrigerant circuit (10) accumulates into a part of the refrigerant circuit (10) of which temperature is the lowest. When the detection value of the indoor air temperature (75) (that is, the indoor air temperature) is smaller than the detection value of the outdoor air temperature sensor (72) (that is, the outdoor air temperature), the temperature of the indoor circuit (22) is lower than that of the outdoor circuit (21), so that the refrigerant flows and accumulates into the indoor circuit (22). It can be inferred from this state that less amount of the refrigerant will accumulate into the outdoor circuit (21) including the compressor (30). In view of this, in the present modified example, the compressor (30) is also stopped during the time when the detection value of the indoor air temperature sensor (75) is smaller than the detection value of the outdoor air temperature sensor (72) in the operation stop of the air conditioner (10), thereby avoiding unnecessary heating of the compressor (30).

It should be noted that the above embodiments are mere essentially preferable examples and are not intended to limit the present invention, applicable objects, and the scope of use.

INDUSTRIAL APPLICABILITY

As described above, the present invention is useful for refrigerating apparatuses including means for heating a compressor in operation stop thereof.

The invention claimed is:

1. A refrigerating apparatus, comprising:

a refrigerant circuit which performs a refrigeration cycle by circulating refrigerant and which includes: a heat source side circuit including a compressor and a heat source side heat exchanger and installed outdoors; and a user side circuit including a user side heat exchanger and installed indoors, the heat source side circuit and the user side circuit being connected to each other, and the heat source side heat exchanger performing heat exchange between the refrigerant and outdoor air, a heating device which heats the compressor;

an outdoor air temperature detection device which detects a temperature of the outdoor air; and a control device configured to, in the operation stop of the refrigerating apparatus, determine whether a detection value of the outdoor air temperature detection device decreases, keep the heating device from heating the compressor during the time when a condition in which a detection value of the outdoor air temperature detection device decreases is satisfied, and allow the heating device to heat the compressor when the condition is not satisfied.

* * * * *